US006978565B1

(12) United States Patent
Tollius

(10) Patent No.: US 6,978,565 B1
(45) Date of Patent: Dec. 27, 2005

(54) DEVICE AND METHOD FOR COMMUNICATION WITH HOUSEKEEPING SERVICES

(76) Inventor: Tom Tollius, Paseo de la Marina sur Lote H-7, Marina Vallarta, Puerto Vallarta, Jal C.P. 48354 (MX)

( * ) Notice: Subject to any disclaimer, the term of this patent is extended or adjusted under 35 U.S.C. 154(b) by 0 days.

(21) Appl. No.: 09/997,492

(22) Filed: Nov. 19, 2001

(51) Int. Cl.[7] ..... G09F 11/00
(52) U.S. Cl. ..... 40/491; 283/99
(58) Field of Search ..... 283/99, 65, 901; 434/199; 40/486, 488, 491, 122; 116/324

(56) References Cited

U.S. PATENT DOCUMENTS

| | | | | | |
|---|---|---|---|---|---|
| 316,288 | A | * | 4/1885 | Merrifield | 40/488 |
| 814,438 | A | * | 3/1906 | Franke | 40/122 X |
| D157,715 | S | | 3/1950 | Wolfe | |
| D174,516 | S | | 4/1955 | Robinson | |
| 2,902,784 | A | * | 9/1959 | Sukul | 40/486 |
| D186,450 | S | | 10/1959 | Manning | |
| 3,064,377 | A | * | 11/1962 | Fitch | 40/491 |
| 3,596,390 | A | * | 8/1971 | Scalice | 40/491 |
| 3,754,227 | A | | 8/1973 | Andersson | |
| 3,763,820 | A | * | 10/1973 | Sage | 40/491 X |
| 3,797,009 | A | | 3/1974 | Crudgington, Jr. | |
| 3,975,837 | A | | 8/1976 | Baars | |
| 3,983,649 | A | * | 10/1976 | Ellis et al. | 40/122 |
| 4,216,598 | A | * | 8/1980 | Newbert | 40/331 |
| 4,217,713 | A | | 8/1980 | Greenberger | 40/488 |
| 4,485,576 | A | | 12/1984 | Greenberger | 40/491 |
| 4,654,990 | A | | 4/1987 | Suters | 40/491 |
| 4,854,061 | A | * | 8/1989 | Khoshkish | 40/495 |
| 4,881,335 | A | | 11/1989 | Khoshkish | 40/449 |
| 5,026,196 | A | | 6/1991 | Brass | |
| 5,029,903 | A | | 7/1991 | Pennock | 283/81 |
| 5,046,273 | A | | 9/1991 | Virvo | 40/571 |
| 5,249,827 | A | | 10/1993 | Olson | |
| 5,255,462 | A | | 10/1993 | Rufenacht | 40/488 |
| 5,513,456 | A | | 5/1996 | Gleason | 40/358 |
| 5,518,409 | A | * | 5/1996 | White | |
| 5,664,851 | A | | 9/1997 | Dunn | 40/312 X |
| 5,671,557 | A | | 9/1997 | Carlson et al. | 40/358 |
| 5,941,713 | A | | 8/1999 | Wayner et al. | |
| 5,948,498 | A | | 9/1999 | Bianco et al. | |
| 5,987,825 | A | | 11/1999 | Rosen | 40/611 |
| 6,113,148 | A | | 9/2000 | Koranda et al. | 283/81 |
| 6,182,386 | B1 | | 2/2001 | Nielsen | 40/491 |

* cited by examiner

*Primary Examiner*—Joanne Silbermann
(74) *Attorney, Agent, or Firm*—Saliwanchik, Lloyd & Saliwanchik

(57) ABSTRACT

A device for communicating a hotel guest's instructions to hotel housekeeping services, and method for such is provided. The communication device provides a means for the guest to indicate whether or not to clean the room or other like instructions or commands. Additionally, the guest can indicate which actions are desired in the room, such as change the bed sheets or change the towels.

6 Claims, 6 Drawing Sheets

DEVICE AND METHOD FOR COMMUNICATION WITH HOUSEKEEPING SERVICES

BACKGROUND OF THE INVENTION

1. Field of the Invention

The present invention relates to a device for communicating a hotel guest's cleaning instructions to hotel housekeeping services, and method for such.

2. Description of the Related Art

In the hotel industry, occupied hotel rooms are typically cleaned on a daily basis. This daily cleaning often includes the replacing of bedding and bath towels. As a result, individual hotels daily generate large quantities of laundry, which require vast amounts of electricity, detergent, and water.

Accordingly, many hotels have instituted policies permitting the hotel guest to decide whether or not to have the bedding and towels replaced daily. In order for the hotel guests to communicate instructions to housekeeping services, hotels have provided various communication means in the hotel rooms. Typically, to communicate instructions, a hotel guest will hang a sign on the door handle, which will instruct housekeeping services on whether or not to replace the bedding and towels. Alternatively, some hotels have instructional cards in the rooms, which the guest completes and leaves on the dresser.

Unfortunately, many times these signs and instructional cards are often lost and/or not replaced, or are not seen and used by the hotel guests. Additionally, they may also go unnoticed by housekeeping services, even when used properly. As a result, housekeeping services often unnecessarily replace a room's bedding and towels.

Accordingly, there remains a need in the hotel industry for a simple, reliable communication means, which can communicate various instructions to housekeeping services.

BRIEF SUMMARY OF THE INVENTION

The present invention provides a device for communicating a hotel guest's instructions to hotel housekeeping services, and method for such.

The communication device of the subject invention comprises a panel frame, which is mounted onto a wall or other vertical surface. A communication means is positioned on the front side of the communication device, where the guest's instructions are displayed. Additionally, the front side comprises a plurality of instruction displays, which are divided into a number of sections: the instruction section, the choice section, and the indicator section. The instruction section comprises the instructions, for example, "Change Sheets" or Change Towels." The choice section is divided into three choices, either "YES," "NO," or "Neutral." The indicator section is where a guest will communicate instructions by placing an adhesive note in the appropriate location.

For example, if a guest would like to have the bed sheets or towels changed, the guest will slide the indicator to "YES." Conversely, if the guest does not wish to have the sheets or towels changed, the guest will indicate "NO."

A hotel will mount the communication-device in a readily accessible and-noticeable location, for example in the bathroom, or in the entryway, allowing for use by both the hotel guest and housekeeping services.

These and other features of the present invention will be more readily understood with reference to the following detailed description, read in conjunction with the accompanying drawing figures.

DETAILED DISCLOSURE OF THE INVENTION

The present invention provides a device for communicating a hotel guest's instructions to hotel housekeeping services, and method for such.

Figure 1:
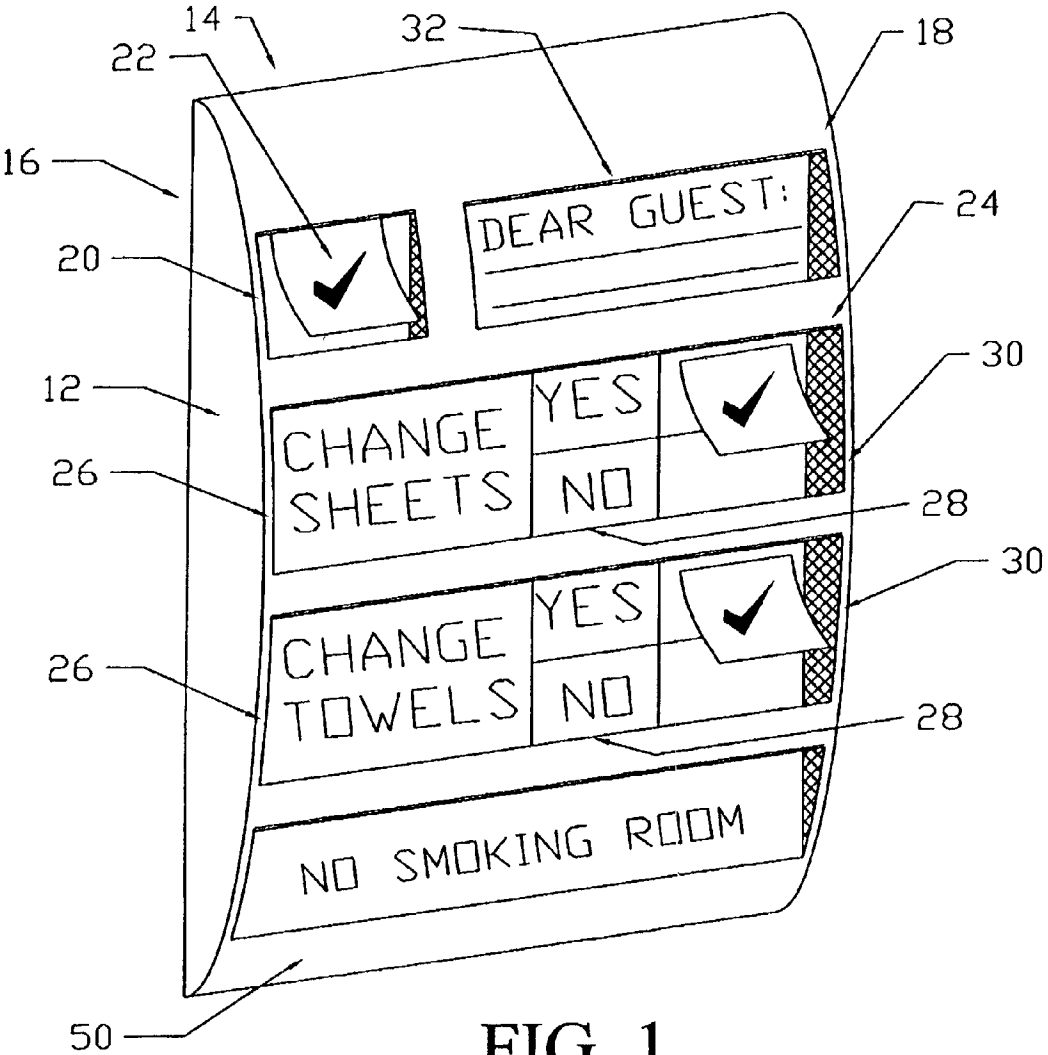
FIG. 1 depicts a perspective view of the communication device of the subject invention.

In an embodiment of the present invention, as shown in FIG. 1, the communication device 10 of the subject invention comprises a panel frame 12, which can be mounted onto a wall or other vertical surface. The panel frame 12 comprises a front side 14 and a backside 16, where the backside 16 is mounted onto the wall and the front side 14 comprises the communication means 18.

In an embodiment, the communication means 18 comprises an indented space 20 for the placing of adhesive notes 22. The adhesive notes 22 contain a printed indicator mark thereon, which are used to identify a hotel guest's instructions. If the adhesive notes 22 become depleted, a new note pad can be inserted into the indented space 20. Additionally, the front side 14 comprises a plurality of instruction displays 24. The instruction displays 24 are divided into a plurality of sections. The instruction section 26 comprises the instructions, for example, "Change Sheets" or Change Towels." Adjacent to the instruction section 26 is the indicator window 28, which is divided into two choices, either "YES" or "NO." Adjacent to the indicator window 28 is the indicator section 30. A guest will communicate instructions by placing an adhesive note 22 in the appropriate location in the indicator section 30.

For example, if a guest would like to have the bed sheets changed, the guest will peal off an adhesive note 22 and place it in the indicator section 30 next to the "YES." Conversely, if the guest does not wish to have the sheets changed, the guest will place the adhesive note 22 in the indicator section 30 next to the "NO."

In an alternative embodiment, the front panel 14 further comprises a message display 32, in which the hotel can leave printed messages to the guests. The message display 32 comprises a flat dry-erase surface, upon which messages can be written and easily erased. Alternatively, the message display 32 contains a note pad, where a message is written on the top sheet of the note pad, and then discarded once read, or a card insert, for the insertion of preprinted messages.

In a further embodiment, the front panel comprises a room type display 50. The room type display 50 can identify the room as either a "SMOKING ROOM" or a "NON-SMOKING ROOM" or other suitable message.

In an alternative embodiment, as shown in FIGS. 2–5, the communication means comprises at least one slot positioned adjacent to a corresponding indicator window, which is positioned adjacent to an instructional section. An indicator is slideably affixed into the slot. The indicator is connected to a display, such that when the indicator is positioned to a first side of the slot, a "YES" is displayed in the indicator window. Similarly, when the indicator is positioned to the opposite side of the slot a "NO" is displayed in the indicator window.

Figure 2:
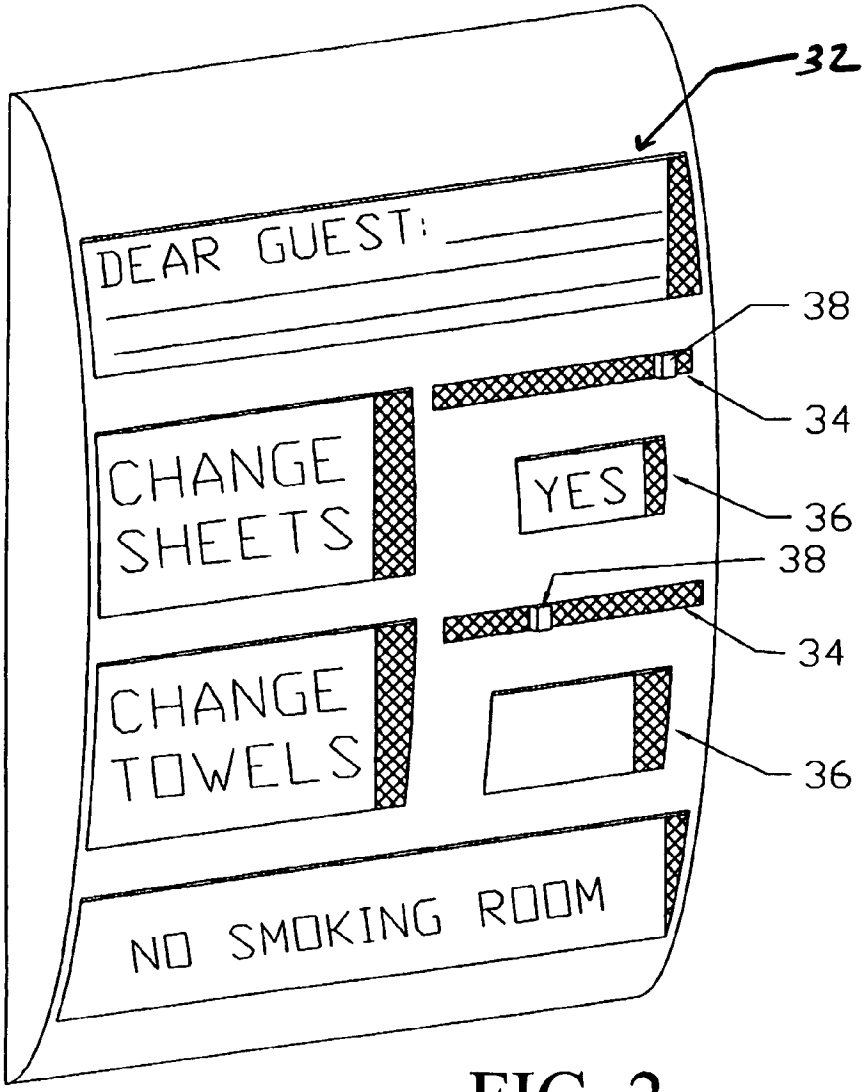
FIG. 2 depicts a perspective view of an alternative embodiment of the communication device of the subject invention.
Figure 4:
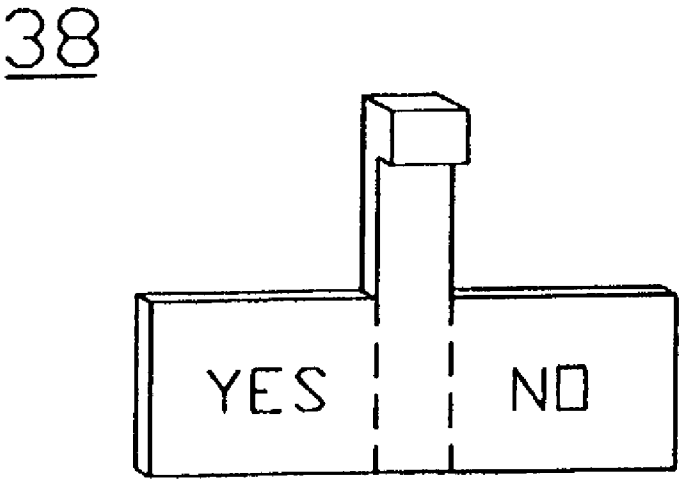
FIG. 4 depicts a perspective view of the horizontal indicator of the alternative embodiment of the communication device of the subject invention.

In an embodiment, as shown in FIG. 2, the front side 14 comprises a horizontal slot 34 positioned above a horizontal indicator window 36, which are positioned adjacent to each instruction section 26. A horizontal indicator 38, as shown in FIG. 4, is slideably affixed into the horizontal slot 34. The horizontal indicator 38 is connected to a movable display 40, such that when the horizontal indicator 38 is positioned to a first side of the horizontal slot 34, a "YES" is displayed in the horizontal indicator window 36. Similarly, when the horizontal indicator 38 is positioned to the opposite side of the horizontal slot 34, a "NO" is displayed in the horizontal indicator window 36.

In an embodiment, when the horizontal indicator 38 is centrally positioned within the slot 34, the horizontal indicator window 36 is empty, in a neutral position.

For example, if a guest would like to have the bed sheets or towels changed, the guest will slide the horizontal indicator 38 to the first side, displaying a "YES" in the horizontal indicator window 36. Conversely, if the guest does not wish to have the sheets or towels changed, the guest will slide the horizontal indicator 38 to the opposite side, displaying a "NO" in the horizontal indicator window 36.

Figure 3:
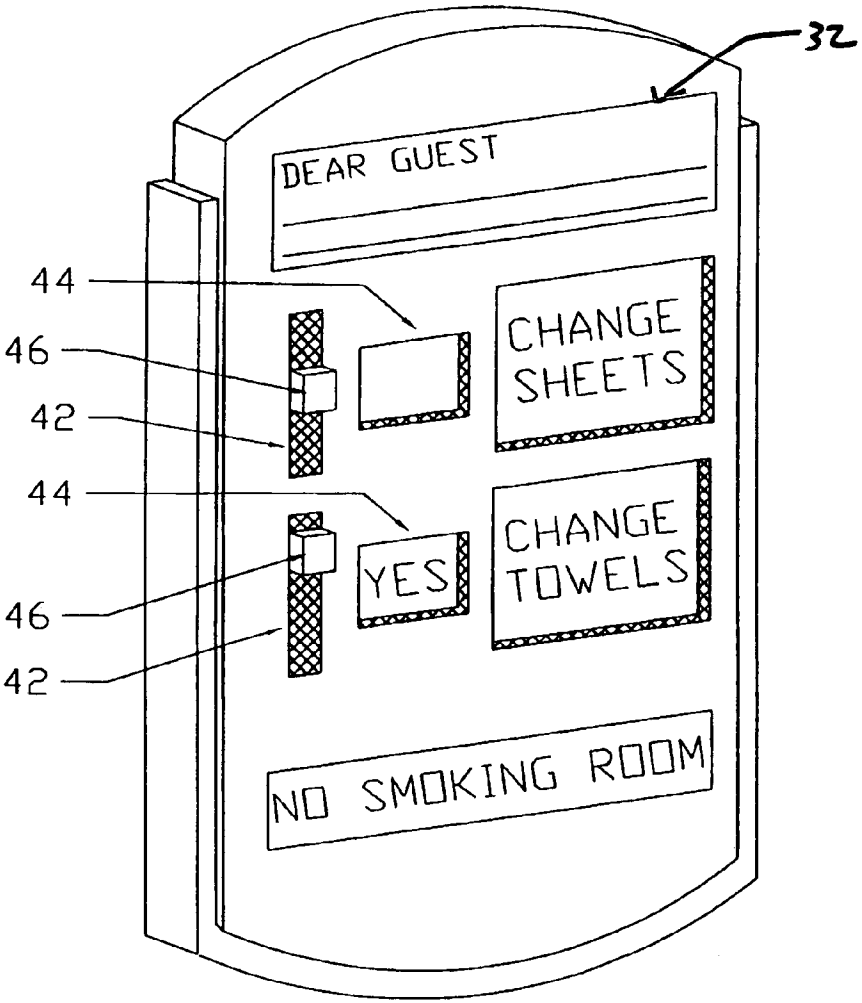
FIG. 3 depicts a perspective view of a further alternative embodiment of the communication device of the subject invention.
Figure 5:
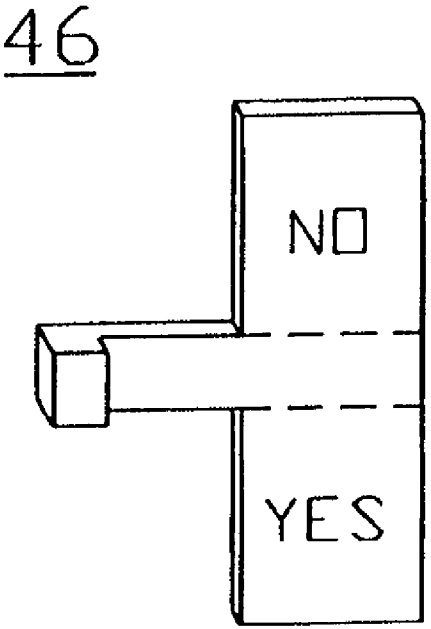
FIG. 5 depicts a perspective view of the vertical indicator of the further alternative embodiment of the communication device of the subject invention.

In an alternative embodiment, as shown in FIG. 3, the front side 14 comprises a vertical slot 42 positioned adjacent to a vertical indicator window 44, which are positioned adjacent to each instructional section 26. A vertical indicator 46, as shown in FIG. 5, is slideably affixed into the vertical slot 42. The vertical indicator 46 is connected to a display 48, such that when the vertical indicator 46 is positioned to a first vertical side of the vertical slot 42, a "YES" is displayed in the vertical indicator window 44. Similarly, when the vertical indicator 46 is positioned to the opposite vertical side of the vertical slot 42 a "NO" is displayed in the vertical indicator window 44.

In an embodiment, when the vertical indicator 46 is centrally positioned within the vertical slot 42, the vertical indictor window 44 is empty, in a neutral position.

For example, if a guest would like to have the bed sheets or towels changed, the guest will slide the vertical indicator 46 to the first vertical side, displaying a "YES" in the vertical indicator window 44. Conversely, if the guest does not wish to have the sheets or towels changed, the guest will slide the vertical indicator 46 to the opposite vertical side, displaying a "NO" in the vertical indicator window 44.

Figure 7:
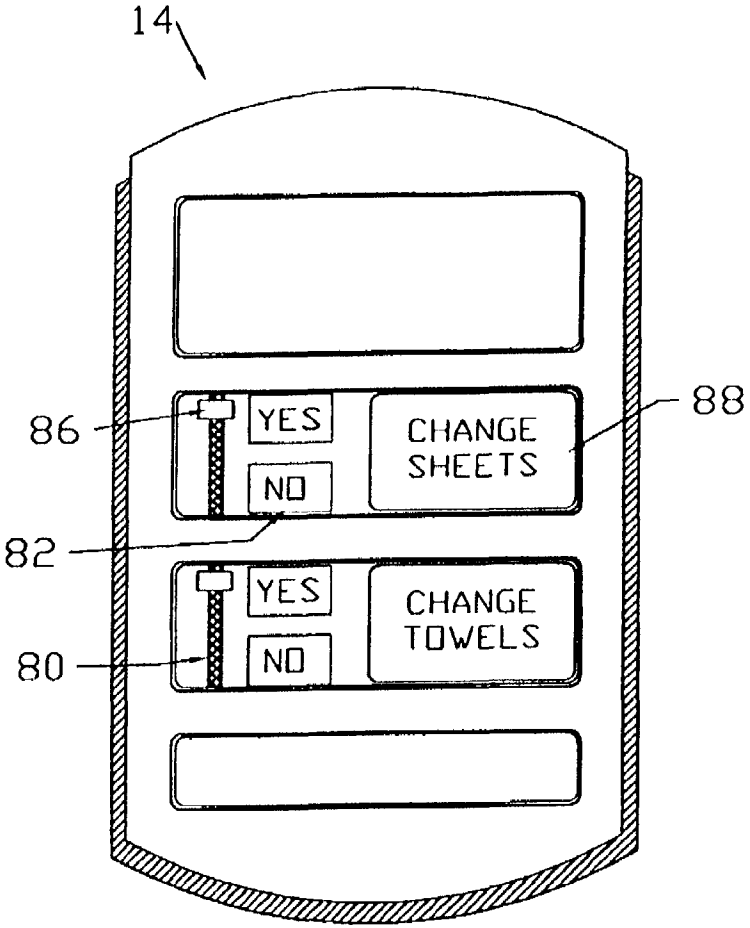
FIG. 7 depicts a front view of a further alternative embodiment of the communication device of the subject invention.

In an alternative embodiment, as shown in FIG. 7, the terms "YES" and "NO" are displayed in the indicator window. A slot 80 is positioned adjacent to an indicator window 82, which is positioned adjacent to the instructional section 84. An indicator 86 is slideably affixed into the slot 80. A guest indicates the instruction by sliding the indicator 86 to a first position, adjacent to the "YES" or a second position adjacent to the "NO" in the indicator window 82.

For example, if a guest would like to have the bed sheets or towels changed, the guest will slide the indicator 86 to the first position, adjacent to the "YES" in the indicator window 82. Conversely, if the guest does not wish to have the sheets or towels changed, the guest will slide the indicator 86 to the second position, adjacent to the "NO" in the vertical indicator window 44.

In an alternative embodiment, the indicator comprises a rotateable disc, with a knob, positioned adjacent to a vertical indicator window, which is positioned adjacent to the instructional section. The rotateable disc is rotateably mounted in the front face 14, where the outer edge of the rotateable disc is imprinted with "YES" and "NO," such that as the disc is rotated, the "YES" or "NO" is displayed within the indicator window.

For example, if a guest would like to have the bed sheets or towels changed, the guest will rotate the knob, displaying a "YES" in the indicator window. Conversely, if the guest does not wish to have the sheets or towels changed, the guest will rotate the knob, displaying a "NO" in the vertical indicator window.

Figure 6:
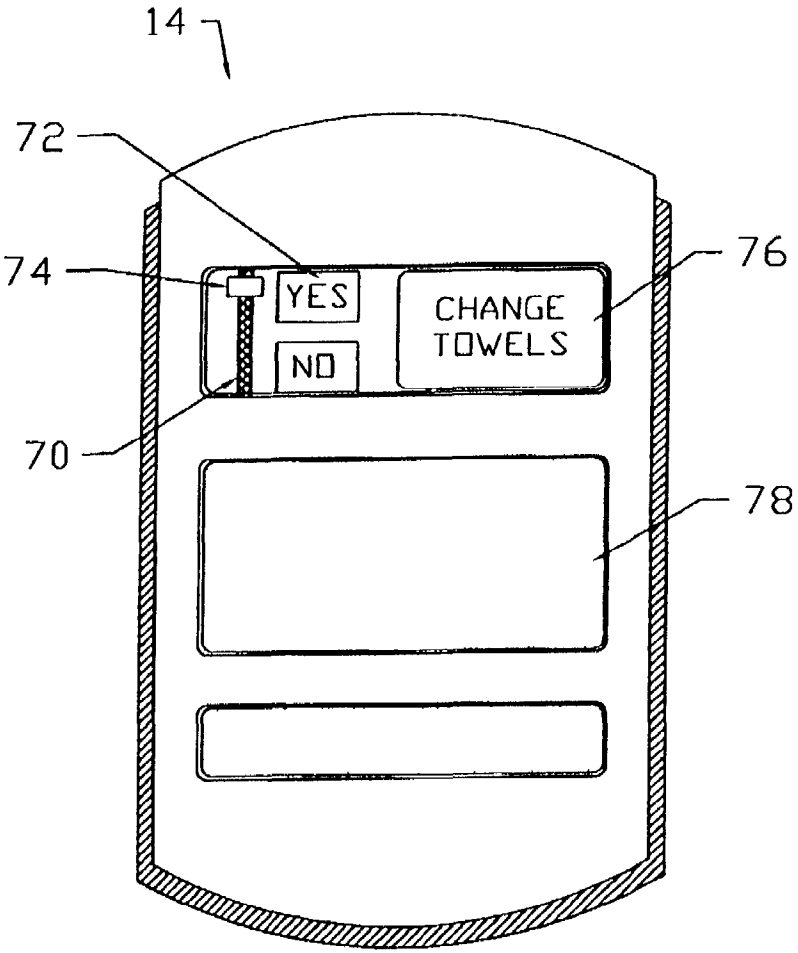
FIG. 6 depicts a front view of a further alternative embodiment of the communication device of the subject invention.

In an embodiment, as shown in FIG. 6, the front side 14 comprises a slot 70 positioned adjacent to a corresponding indicator window 72, which is positioned adjacent to an instructional section 76. An indicator 74 is slideably affixed into the slot 70. The front side 14 further comprises a message display 78, in which the hotel can leave printed messages to the guests.

For example, if a guest would like to have the towels changed, the guest will slide the indicator 74 to the first side, indicating a "YES" in the indicator window 72. Conversely, if the a guest does not wish to have the towels changed, the guest will slide the indicator 74 to the opposite side, indicating a "NO" in the indicator window 72. Additionally, the message display 78 informs the guest of the hotel policy regarding the changing of bed sheets, i.e., sheets will be changed every day, every second day, every third day, or every fourth day, and the like.

Figure 8:
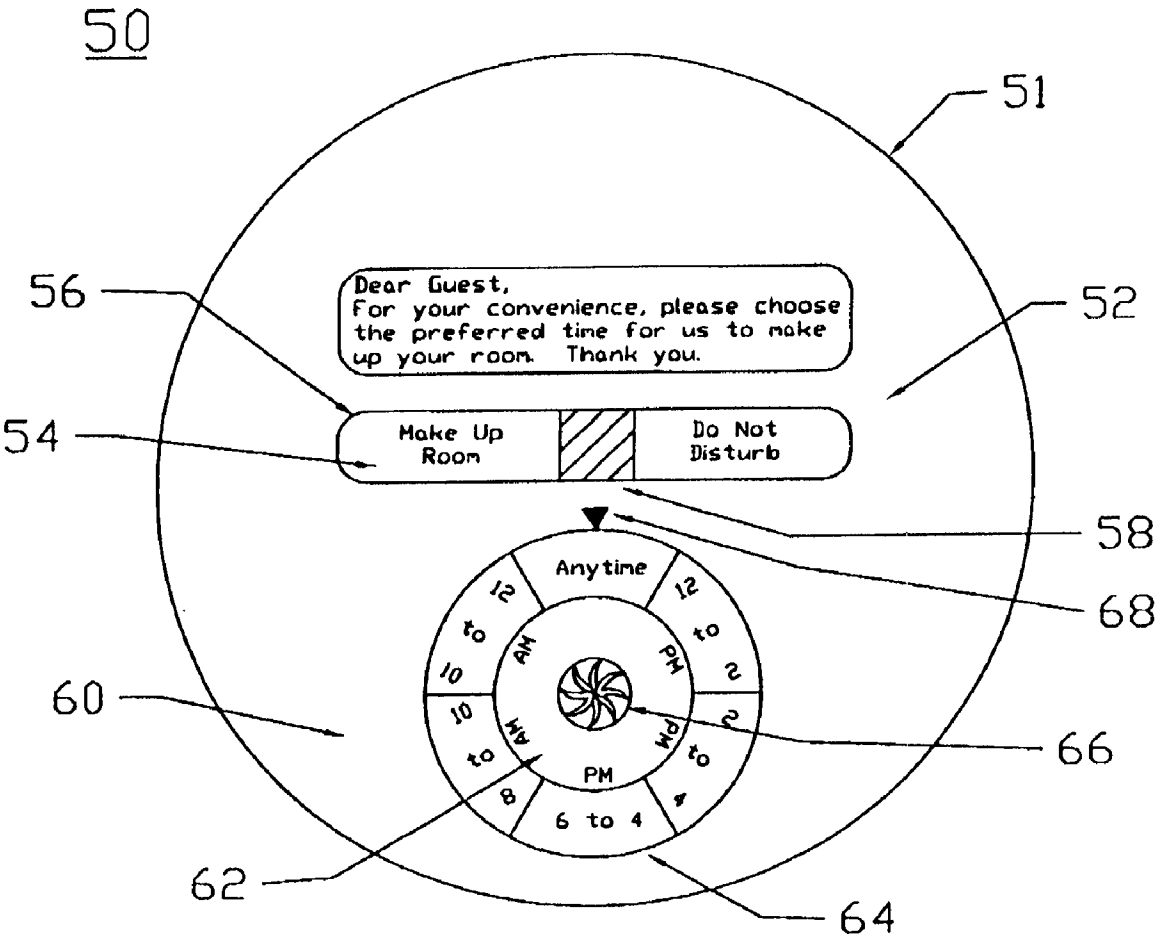
FIG. 8 a front view of a still further embodiment of the communication device of the subject invention

In an embodiment, as shown in FIG. 8, the subject invention includes a communication device 50 for communicating to housekeeping services if and when the room will be available for cleaning. The communication device 50 comprises an instruction display 52 and availability display 60. The instruction display 52 comprises a set of instructions 54, such as, "Make Up Room" or "Do Not Disturb." The instructions 54 are mounted into an indentation 56 on the front face 51 of the communication device 50. An instruction indicator 58 is slideably mounted in the indentation 56, such that the instruction indicator 58 can be positioned to indicate the guest's instructions. For example, if a guest does not wish to be disturbed, the instruction indicator 58 is slid over the "Make Up Room" instruction 54, displaying the "Do Not Disturb" instruction 54. Alternatively, if a guest wishes to have the room cleaned, the instruction indicator 58 is slid over the "Do Not Disturb" instruction 54, displaying the "Make Up Room" instruction 54.

If a guest wishes to have the room cleaned, the guest will indicate the room availability time with the availability display 60. The availability display 60 comprises a rotateable disc 62, a knob 66, and an availability indicator 68. The rotateable disc 62 is rotateably mounted onto the front face 51 of the communication device 50, where the outer edge 64 of the rotateable disc 62 is imprinted with available time ranges, for example, "Any Time", 8 a.m.–10 a.m., 10 a.m.–12 a.m., 12 p.m.–2 p.m., 2 p.m.–4 p.m., or 4 p.m.–6 p.m. The knob 66 is centrally affixed to the rotateable disc 62, where the knob 66 is used to rotate the rotateable disc 62 about a central axis. The availability indicator 68 is mounted to the communication device 50 such that, the availability indicator 68 indicates the time the room is available for cleaning. For example, the availability indicator 68 is an arrow mounted to the communication device 50, such that the rotateable disc 62 is rotated until the arrow points to the time at which the room will be available.

A hotel will mount the communication device of the subject invention, in a readily accessible and noticeable location, for example in the bathroom, in the entryway, on the door, or the like.

It should be understood that the examples and embodiments described herein are for illustrative purposes only and that various modifications or changes in light thereof will be suggested to persons skilled in the art and are to be included within the spirit and purview of this application and the scope of the appended claims. For example the "YES" and "NO" may be some other form of communicating commands, including a color scheme, such as red an green, various icons, symbols, or the like.

What is claimed is:

1. A method for communicating instructions from a hotel guest to a hotel staff on whether to change towels in the hotel room of the quest, wherein said method comprises the steps of:

providing in the room of the hotel guest a hotel communication device comprising at least one indicator, at least one indicator slot, at least one indicator window, and at least one instructional window, wherein said indicator slot is adjacent to said indicator window, and said indicator window is adjacent to said instructional window, wherein said indicator window displays a positive command and a negative command, and said instructional window displays at least one instruction, and said indicator slot comprises an indicator slideably affixed in said slot, such that when said indicator is in a first position said indicator is adjacent to said positive command and when said indicator is in a second position said indicator is adjacent to said negative command, wherein said at least one instruction is to change towels, wherein said device is mounted on a wall or door in the hotel Guest room;

wherein said method further comprises the hotel guest selecting a positive command or negative command in said indicator window; and sliding said indicator to a desired position in said indicator slot to indicate the selected command on whether to change towels;

wherein said method further comprises the hotel staff seeing the command selected by the hotel guest, and indicated by the device in the hotel guest room; and wherein said method further comprises the hotel staff carrying out the selected command on whether to chance towels.

2. The method, according to claim 1, wherein said indicator is a vertical slot.

3. The method, according to claim 1, wherein said hotel communication device further comprises a room type display.

4. A method for communicating instructions from a hotel guest to a hotel staff on whether to change sleets in the hotel room of the guest, wherein said method comprises the steps of:

providing in the room of the hotel guest room a hotel communication device comprising at least one indicator, at least one indicator slot, at least one indicator window, and at least one instructional window, wherein said indicator slot is adjacent to said indicator window, and said indicator window is adjacent to said instructional window, wherein said indicator window displays a positive command and a negative command, and said instructional window displays at least one instruction, and said indicator slot comprises an indicator slideably affixed in said slot, such that when said indicator is in a first position said indicator is adjacent to said positive command and when said indicator is in a second position said indicator is adjacent to said negative command, wherein said at least one instruction is to change sheets, wherein said device is mounted on a wall or door in the hotel guest room;

wherein said method further comprises the hotel guest selecting a positive command or negative command in said indicator window; and sliding said indicator to a desired position in said indicator slot to indicate the selected command on whether to change sheets;

wherein said method further comprises the hotel staff seeing the command selected by the hotel guest, and indicated by the device in the hotel guest room; and wherein said method further comprises the hotel staff carrying out the selected command on whether to change sheets.

5. The method, according to claim 4, wherein said indicator is a vertical slot.

6. The method, according to claim 4, wherein said hotel communication device further comprises a room type display.

* * * * *